US005643153A

United States Patent [19]

Nylen et al.

[11] Patent Number: 5,643,153

[45] Date of Patent: Jul. 1, 1997

[54] FLYWHEEL RESISTANCE MECHANISM FOR EXERCISE EQUIPMENT

[75] Inventors: James E. Nylen, Champlin; Steven A. Rose, Minneapolis; Terrence D. Wood, Fridley, all of Minn.

[73] Assignee: Nordic Track, Inc., Chaska, Minn.

[21] Appl. No.: 337,134

[22] Filed: Nov. 10, 1994

Related U.S. Application Data

[63] Continuation of Ser. No. 9,458, Jan. 27, 1993, abandoned.

[51] Int. Cl.[6] ..... A63B 69/18

[52] U.S. Cl. ..... 482/110; 482/70

[58] Field of Search ..... 482/51, 70, 110, 482/52, 54, 71, 72; 29/156.4 R, 33 C, DIG. 5, DIG. 10

[56] References Cited

U.S. PATENT DOCUMENTS

| | | | |
|---|---|---|---|
| 3,969,804 | 7/1976 | MacInnes et al. | 29/156.4 R |
| 4,023,795 | 5/1977 | Pauls | 482/70 |

*Primary Examiner*—Stephen R. Crow
*Attorney, Agent, or Firm*—James R. Hakomaki

[57] ABSTRACT

The present invention provides a flywheel resistance mechanism for exercise equipment. The flywheel rotates subject to frictional resistance created by contact between a drag strap and an outer cylindrical surface on the flywheel. The outer cylindrical surface has a surface roughness of between fifteen (15) microinches and one hundred and fifty (150) microinches.

13 Claims, 4 Drawing Sheets

FLYWHEEL RESISTANCE MECHANISM FOR EXERCISE EQUIPMENT

This is a continuation of application Ser. No. 08/009,458, filed Jan. 27, 1993, which was abandoned upon the filing hereof.

FIELD OF THE INVENTION

The present invention relates generally to exercise equipment, and more particularly, to an exercise resistance mechanism having a flywheel that rotates subject to frictional resistance created by a drag strap in contact with an outer cylindrical surface on the flywheel.

BACKGROUND OF THE INVENTION

Exercise equipment has been designed using a variety of resistance mechanisms. One known exercise resistance mechanism includes a flywheel that rotates against frictional resistance created by contact between a drag strap and an outer cylindrical surface on the flywheel. This particular resistance mechanism has been incorporated into cross-country skiing exercise machines, such as those disclosed in U.S. Pat. Nos. 4,023,795 and 4,728,102, rowing exercise machines, such as that disclosed in U.S. Pat. No. 5,072,929, and other types of exercise apparatus, such as the combination exercise apparatus designated as 100 in FIG. 5 herein.

In general, the above-identified flywheel mechanism provides resistance that is highly desirable for the intended purpose. However, one disadvantage of this prior art flywheel mechanism is that the resistance to exercise does not always remain consistent during extended operation. In extreme cases, the resistance level increases or "creeps" by as much as fifty percent (from twenty (20) pounds to thirty (30) pounds) during only twenty minutes of continuous operation. Even in more moderate cases, the "creep" or load increase is perceptible to the user of the exercise apparatus, and any perceived deviation is obviously undesirable.

Numerous experiments and tests have been conducted in an effort to identify the cause of and solve this problem with "creeping" resistance levels but without success prior to the present invention. For example, Prior Art flywheel resistance mechanisms have used sand cast grey iron flywheels and die cast zinc flywheels alternatively with nylon straps and woven polyester straps, but none of these combinations proved to be the solution to the "creeping" resistance problem. Additional attempts to eliminate "creeping" resistance have involved coating the outer cylindrical surface of the flywheel with a lubricant or plating the outer cylindrical surface with materials such as chrome or porcelain but without success. At one point, plating the surface with black zinc was thought to be the solution, but further testing proved otherwise. Since none of the prior art combinations have effectively eliminated the inconsistent resistance problem, the need remains for an improvement to this type of resistance mechanism so that the frictional resistance remains essentially constant during extended operation.

SUMMARY OF THE INVENTION

According to one embodiment, the present invention provides a resistance mechanism for exercise equipment. The resistance mechanism includes a flywheel that rotates subject to frictional resistance created by contact between a drag strap and an outer cylindrical surface on the flywheel. The outer cylindrical surface is cast iron having a finished surface roughness of at least twenty (20) microinches and no greater than one hundred and fifty (150) microinches, as measured "peak to valley" using a profilometer. As such, the present invention provides essentially constant resistance during extended periods of continuous operation, thereby eliminating the "creeping" resistance problem associated with the Prior Art flywheel mechanisms, as discussed above in the Background of the Invention. In other words, the present invention derives from the discovery that flywheels having a "relatively rough" contact surface, as opposed to a finely cut, lubricated or plated contact surface, do not experience the same magnitude of "creeping" resistance.

According to a preferred embodiment of the present invention, the flywheel is cast grey iron (#30), and the drag strap is woven polyester. After casting, the flywheel is painted black, and the center of the flywheel is bored to facilitate mounting on a shaft. A groove is cut into the circumference of the flywheel to create the contact surface and peripheral flanges disposed on opposite sides of the contact surface. The peripheral flanges extend radially outward beyond the contact surface, such that and any portion of the drag strap in contact with the outer cylindrical surface is necessarily disposed between the peripheral flanges. The preferred embodiment also includes a tension adjusting means for adjusting the tension in the drag strap and thus, the amount of frictional resistance during operation.

According to another embodiment, the present invention provides an exercise apparatus having at least one moveable member and a resistance means that provides resistance to movement of the moveable member. The resistance means includes a flywheel that rotates subject to frictional resistance created by contact between a drag strap and an outer cylindrical surface on the flywheel. The outer cylindrical surface has a surface roughness of at least twenty (20) microinches and no greater than one hundred and fifty (150) microinches. The improved flywheel mechanism can be used on all compatible types of exercise equipment, including but not limited to cross-country skiing exercise apparatus, rowing exercise apparatus, and treadmill exercise apparatus.

The present invention further provides a method of manufacturing a flywheel designed to rotate subject to frictional resistance created by contact between a drag strap and an outer cylindrical surface on the flywheel. The method involves preparing the contact surface of the flywheel to have a surface roughness of between fifteen (15) microinches and one hundred and fifty (150) microinches, as measured "peak to valley" using a profilometer. In a preferred mode of manufacturing, the flywheel is sand cast grey iron, and after casting, the flywheel is painted black. Then, the flywheel is mounted on a lathe in order to drill or bore a hole through the central hub of the flywheel and "cut" the cylindrical contact surface.

A 35 degree carbide or ceramic insert is used to "cut" a groove into the circumference of the flywheel, thereby creating the contact surface and the bordering peripheral flanges. The surface roughness of the contact surface is a function of the type of cutting tool, the "wear" on the cutting tool, the speed of rotation of the flywheel, and the speed of travel of the cutting tool across the groove. The various process parameters are monitored to ensure that the surface roughness of the contact surface falls within the range of the present invention. Every hour, a flywheel is selected for surface roughness measurement.

Contrary to Prior Art methods, which were directed toward making the contact surface as smooth as possible, the process of the present invention consistently produces "relatively rough" flywheels that provide essentially constant resistance (within one pound) for an extended period of operation at flywheel speeds as high as 750 rpm and load forces as high as 30 pounds. The present invention flywheel is also less expensive than many of the Prior Art flywheels that required additional steps and/or materials to manufacture. These and other advantages of the present invention will become apparent upon a more detailed description of the preferred embodiment.

BRIEF DESCRIPTION OF THE DRAWINGS

With reference to the Drawing, wherein like numerals represent like parts and assemblies throughout the several views.

DETAILED DESCRIPTION OF A PREFERRED EMBODIMENT

Figure 1:
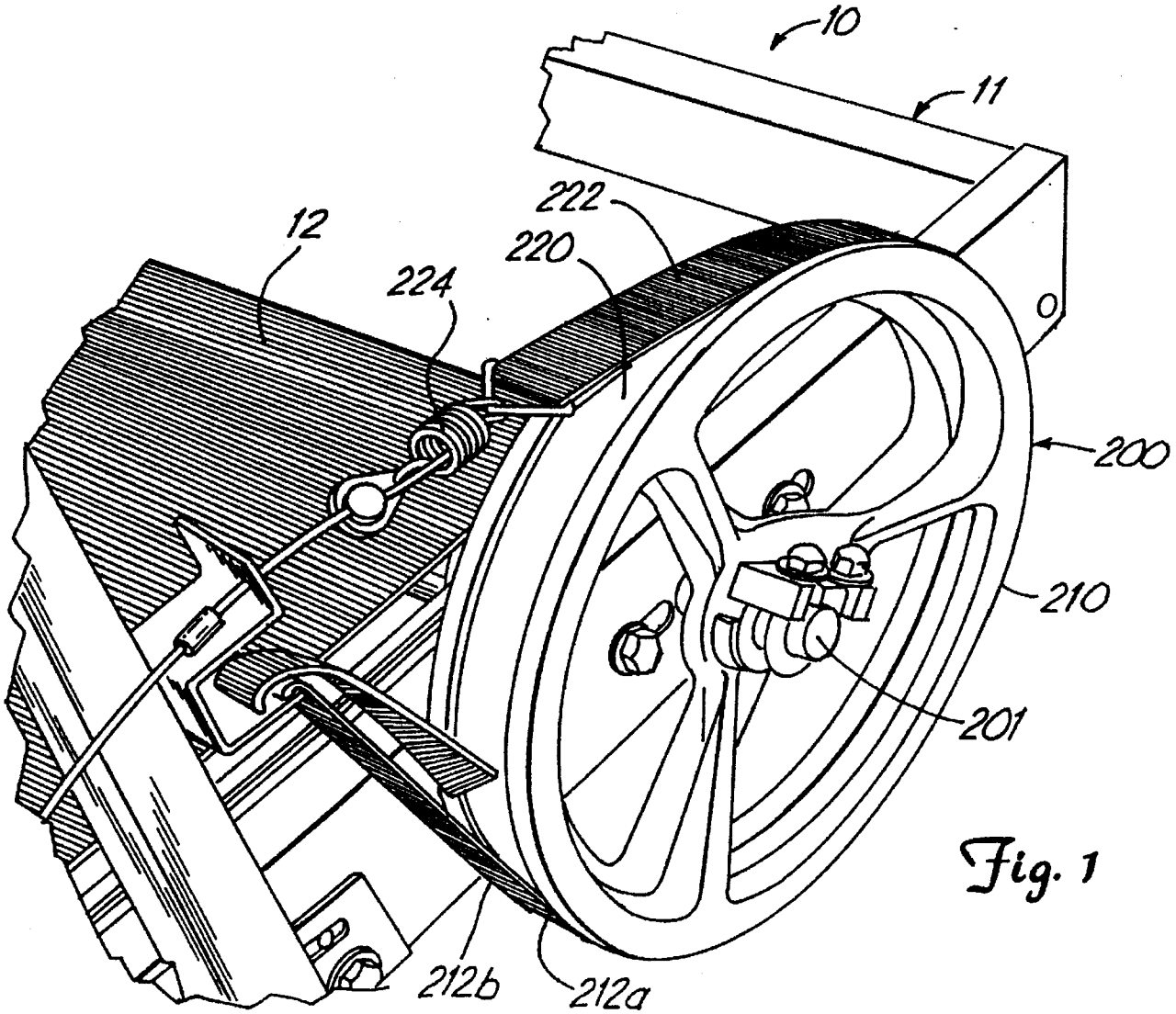
FIG. 1 is a perspective view of a preferred embodiment flywheel constructed according to the principles of the present invention and rotatably mounted on a treadmill exercise apparatus.
Figure 3:
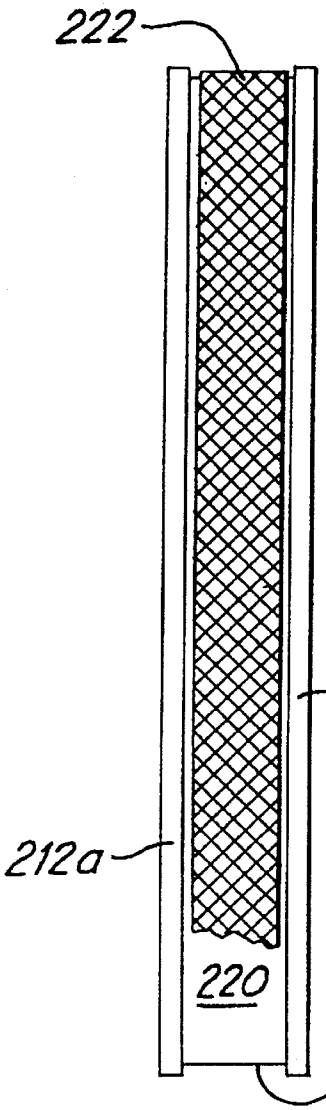
FIG. 3 is a side view of the flywheel shown in FIG. 1.
Figure 2:
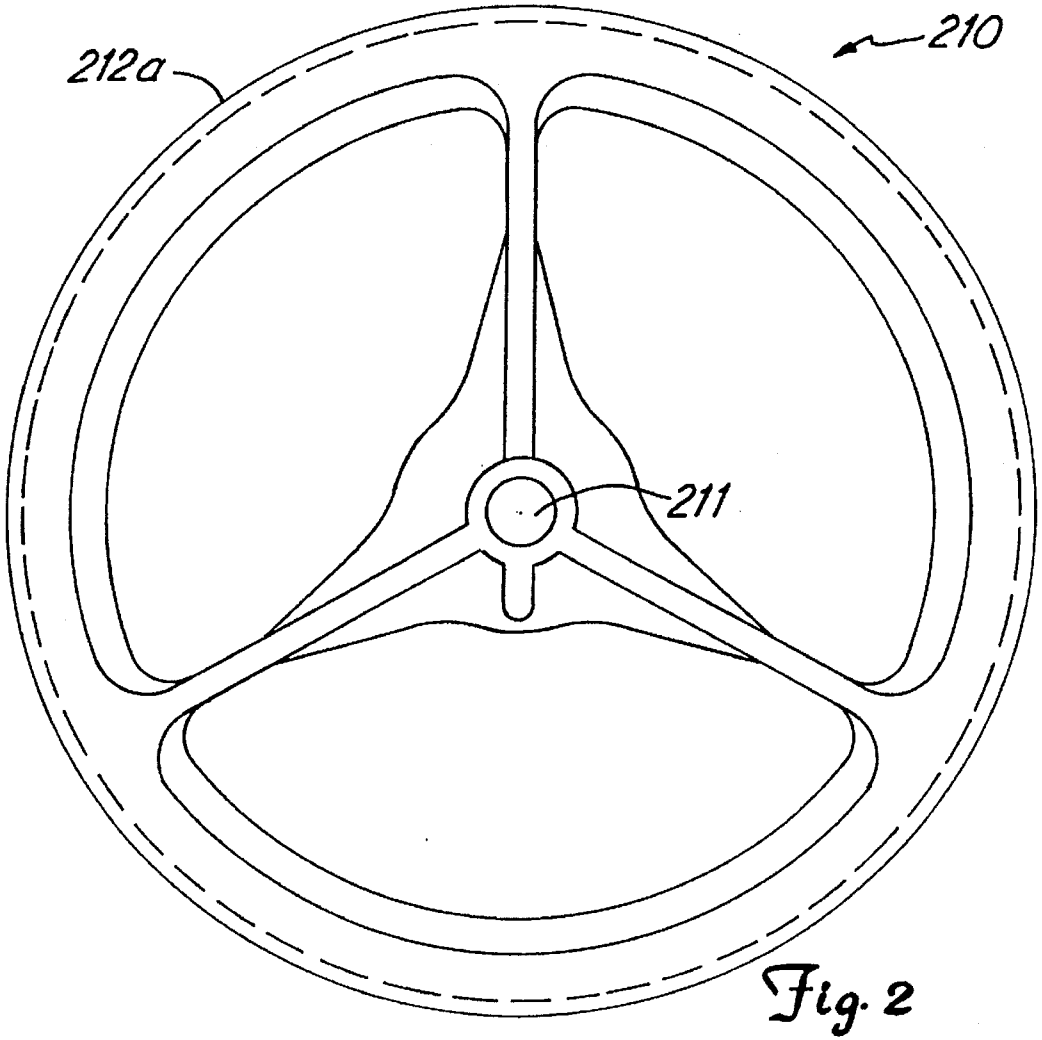
FIG. 2 is a front view of the flywheel shown in FIG. 1.

A preferred embodiment flywheel resistance mechanism constructed according to the principles of the present invention is designated as 200 in FIG. 1. The flywheel resistance mechanism 200 can be used on a variety of exercise equipment, such as the treadmill exercise apparatus 10 shown in FIG. 1, the cross-country skiing exercise machine 20 shown in FIG. 4, and the combination exercise machine 100 shown in FIG. 5. The flywheel resistance mechanism 200 can also be used on additional types of amenable exercise equipment not shown herein, such as the rowing exercise machine shown in U.S. Pat. No. 5,072,929. U.S. Pat. Nos. 4,023,795, 4,728,102, and 5,072,929 are incorporated herein by reference to the extent that they facilitate understanding of the present invention.

The flywheel resistance mechanism 200 includes a flywheel 210 having a central hub 211 that slides onto a shaft 201 to mount the flywheel 210 to the exercise apparatus 10. The flywheel 210 is keyed to the shaft 201 and rotates together with the shaft 201 relative to the frame 11 of the exercise apparatus 10. The flywheel 210 has a circumferential groove 219 defined by an outer cylindrical surface 220 that is bordered by left and right flanges **212*a* and 212*b*, respectively. A drag strap 222 wraps around some portion of the outer cylindrical surface 220 and is disposed between the left and right flanges 212*a* and 212*b*. Both ends of the drag strap 222 are anchored relative to the exercise apparatus frame 11, and a coil spring 224 maintains tension in the drag strap 222. As a person walks on the treadmill 12, the flywheel 210 rotates subject to frictional resistance created by contact between the drag strap 222 and the outer cylindrical surface 220. The resistance level can be adjusted by increasing or decreasing the tension in the spring 224 and hence, the drag strap 222**.

Figure 4:
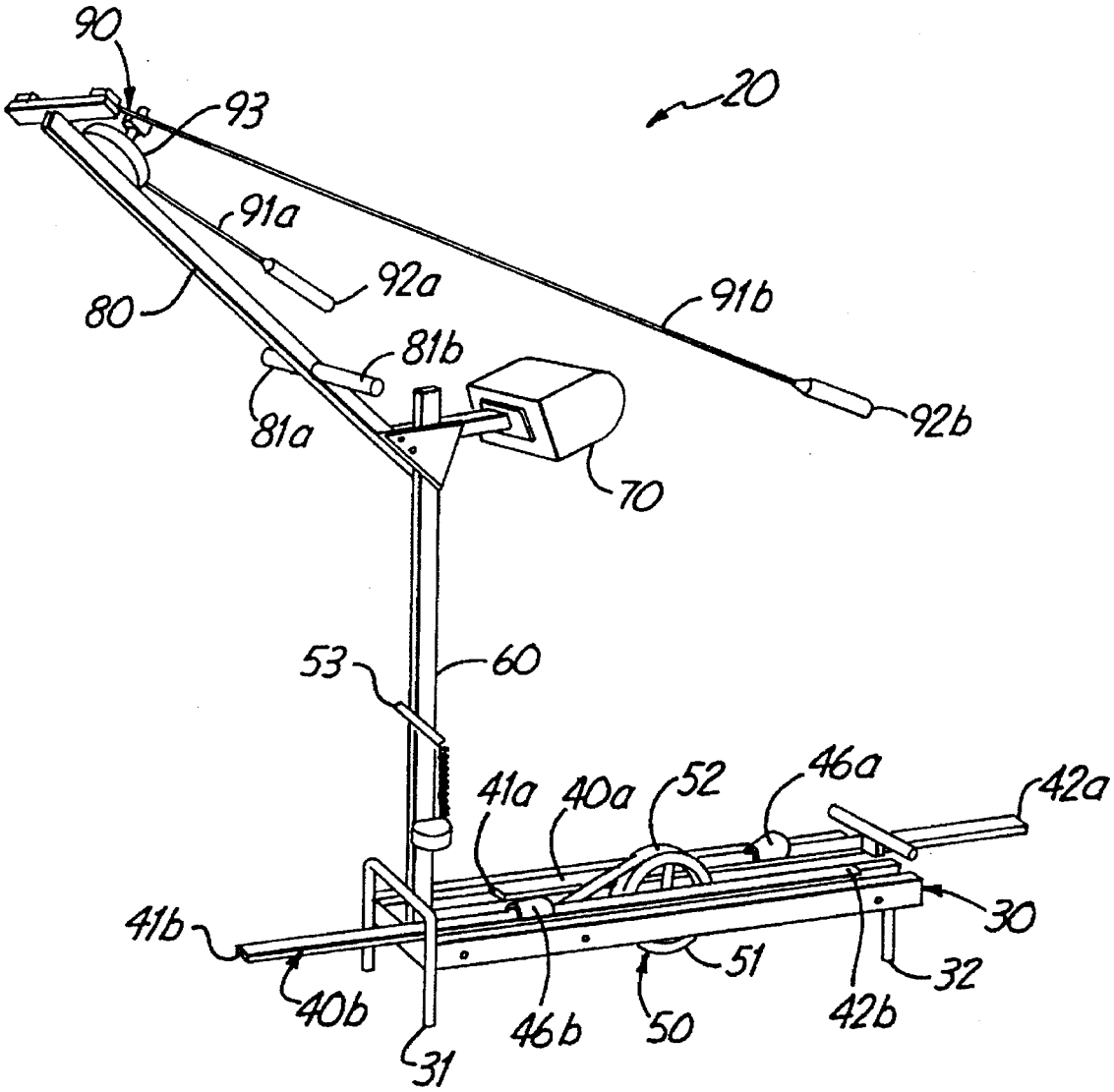
FIG. 4 is a perspective view of a cross-country skiing exercise apparatus including a flywheel similar to those shown in FIGS. 1–3.

With reference to FIG. 4, the cross-country skiing exercise apparatus 20 includes a base 30 having a front leg assembly 31 and a rear leg assembly 32 that are designed to rest upon a floor surface. A pair of simulator skis **40*a* and 40*b* are slideably mounted relative to the base 30. Each of the skis 40*a* and 40*b* extends from a respective front end 41*a* and 41*b* to a respective rear end 42*a* and 42*b*, and each has a respective toe loop 46*a* and 46*b*** mounted on a respective intermediate portion therebetween.

Although the simulator skis **40*a* and 40*b* are several times longer than a person's foot, those skilled in the art will recognize that the skis need only be long enough to effectively support a person's foot, and the present invention is not limited in this regard. Indeed, many commercially available striding devices have simulator skis or foot members that are significantly shorter than those shown in FIG. 4**. One such Prior Art cross-country skier is disclosed in U.S. Pat. No. 4,650,077 to Stropkay.

With reference back to the skier 20 shown in FIG. 4, a resistance means 50 is operatively connected to the base 30 and the skis **40*a* and 40*b*, such that the skis 40*a* and 40*b* slide rearward relative to the base 30 subject to resistance provided by the resistance means 50. In a preferred embodiment, the skis 40*a* and 40*b* are supported on drive rollers that are connected to a main shaft by one-way clutches, so that the shaft rotates in response to rearward movement of the skis 40*a* and 40*b*, but the shaft "free wheels" during forward movement of the skis 40*a* and 40*b*. The resistance means 50 includes a flywheel 51 that is mounted on the shaft and rotates together with the shaft, subject to frictional forces between an outer cylindrical surface of the flywheel 51 and a drag strap 52 secured about the outer cylindrical surface of the flywheel 51**.

The exercise apparatus 20 further includes a post 60 that is mounted relative to the base 30 and extends in a substantially vertical direction from the base 30 when in an operable position. A clip 53 is slideably mounted relative to the post 60 to releasably secure the drag strap 52 along the post 60 and thereby set the relative tension in the drag strap 52 and the corresponding level of resistance to rotation of the flywheel 51.

The skier 20 further includes a pelvis support 70 that is slideably secured relative to the post 60. The pelvis support 70 is designed to support the pelvis/hips of a person using the apparatus 20, and the elevation of the pelvis support 70 is adjustable along the post 60 to accommodate persons of various heights. A bar 80 is mounted relative to the post 70 and extends in a forward and upward direction from the post 70 when in an operable position, defining an angle of approximately 130 degrees therebetween. A pair of fixed handles **81*a* and 81*b* extend laterally from opposite sides of the bar 80**.

An arm exercise unit 90 is secured relative to a distal end of the bar 80. The arm exercise unit 90 includes a pair of lines **91*a* and 91*b* that are designed to be pulled from a drum 93 in reciprocating fashion, subject to a frictional resistance force. A pair of free handles 92*a* and 92*b* are disposed on respective distal ends of the pair of lines 91*a* and 91*b***.

In operating the skier 20 shown in FIG. 4, a person faces toward the pelvis support 70, places a foot on each of the skis **40*a* and 40*b*, and leans forward slightly to rest his or her pelvis/hips against the pelvis support 70. The person may additionally grasp a free handle 92*a* or 92*b* in each hand or simply hold onto the sides of the pelvis support 70 or the fixed handles 81*a* and 81*b*. The person then "shuffles" his or her feet back and forth, alternately pushing one of the skis 40*a* and 40*b* rearward against the resistance from the flywheel 51 and pulling the other of the skis 40*a* and 40*b* forward subject to minimal resistance. The person also has the option of alternately pulling one of the free handles 92***a* and 92*b* rearward against resistance from the drum, while the other of the free handles 92*a* and 92*b* is reciprocally pulled forward.

On cross-country ski machines such as that discussed above and shown in FIG. 4, the flywheel rotates as fast as 750 rpm and provides a resistance load as great as 30 pounds. Even at significantly lower speeds and resistance loads, Prior Art flywheel resistance mechanisms were experiencing a persistent problem with "creeping" resistance during extended operation, as discussed in the Background of the Invention. Preliminary efforts to solve this problem focused on lubricants and coatings that would make the contact surface as smooth as possible. At one point, plating the contact surface with zinc was thought to be an acceptable solution, but further testing revealed that some of the zinc plated flywheels were "failing" just like all of its predecessors. Continued experimentation and testing led to the conclusions that (1) the initial zinc plated flywheels were "successful" simply because they had relatively rough contact surfaces that remained rough even after zinc plating; and (2) the "creeping" resistance problem is effectively eliminated by making the contact surface relatively rough, as opposed to applying any particular type of coating on the contact surface.

The present invention was refined somewhat by conducting additional tests with flywheels having a range of relatively rough surface roughnesses between twenty (20) and one hundred and twenty (120) microinches, as measured "peak to valley" using a profilometer. Thirty-four such flywheels were tested for thirty minutes at a resistance level setting of 20 pounds, and the actual resistance remained consistently within one pound of the 20 pound setting. Seven of the thirty-four flywheels were then tested for over 100 hours, and the actual resistance still remained within one pound of the 20 pound setting. Additional testing suggests that the surface roughness can be as low as fifteen (15) microinches and as great as one hundred and fifty (150) microinches.

The preferred embodiment drag strap 222 is made of woven polyester, and the preferred embodiment flywheel 210 is sand cast grey iron (#30). Ideally, the outer cylindrical surface of the flywheel is cast iron that has been machined to have surface roughness of 85 microinches, primarily since this measurement falls halfway between the experimentally determined minimum surface roughness of twenty (20) microinches and the experimentally determined maximum surface roughness of one hundred and fifty (150) microinches. If the surface roughness is much smoother than twenty (20) microinches, then the Prior Art problem of "creeping" resistance will likely result. If the surface roughness is much greater than one hundred and fifty (150) microinches, then the contact surface 220 will likely damage the drag strap 222.

Figure 5:
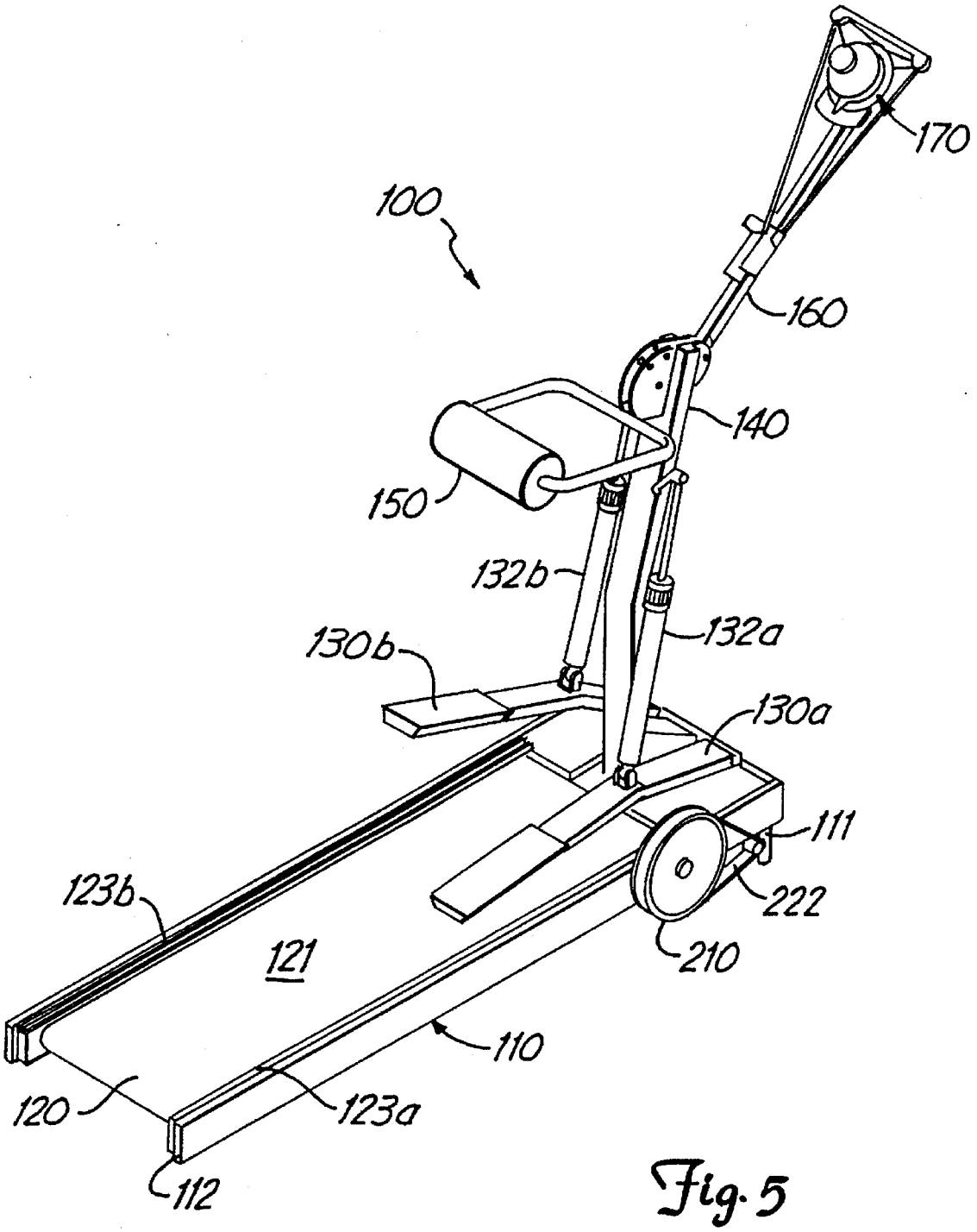
FIG. 5 is a perspective view of a combination exercise apparatus including a flywheel similar to those shown in FIGS. 1–3.

The present invention is applicable to other types of exercise equipment having at least one moveable member (in addition to those shown in FIGS. 1 and 4). For example, as shown in FIG. 5, the flywheel 210 and the drag strap 222 provide a resistance mechanism for an exercise apparatus 100 that is a combination skier, stepper, and treadmill. The apparatus 100 has a frame 110 that extends from a front end 111 to a rear end 112. A treadmill belt 120 is supported by rollers (not shown) in such a manner that the treadmill belt 120 is rotatable relative to the frame 110. On of the rollers is connected to the flywheel 210 in such a manner that the flywheel 210 rotates together with the roller. Thus, a person standing on the treadmill belt 120 walks in place to drive the upper surface of the treadmill belt 120 rearward subject to the drag strap resistance.

The apparatus 100 further includes a pair of skates (not shown) that engage tracks on either side of the treadmill belt 120. The skates are fitted with rollers and one-way clutches in such a manner that the skates roll forward relative to the treadmill belt 120 but "lock" against rearward movement relative to the treadmill belt 120. Thus, a person wishing to "ski" stands on the skates and "shuffles" his or her feet back and forth subject to drag strap resistance during the rearward motion and minimal resistance during the forward motion. A post 140 extends upward from the front end 111 of the frame 110, and a pad 150 is pivotally mounted on the post 140 to provide a support against which the person can brace his or her pelvis/hips. A bar 160 extends upward and forward from the post 140, and an arm exercise unit 170 is mounted on the distal end of the bar 160 to simulate "poling" and/or exercise the person's arms.

The stepper portion of the apparatus 100 includes a pair of pedals 130*a* and 130*b* that are pivotally mounted to the front end 111 of the frame 110. The pedals 130*a* and 130*b* are suspended by a respective pair of hydraulic or pneumatic cylinders 132*a* and 132*b* that provide resistance to downward movement of the pedals 130*a* and 130*b*, respectively. The pedals 130*a* and 130*b* are interconnected to move up and down in reciprocating fashion.

As shown in, as well as U.S. Pat. No. 5,072,929, the flywheel and drag strap combination of the present invention can be used as a resistance mechanism for a rowing exercise apparatus, where the "at least one moveable member" includes a movable handle, a moveable seat, or both. Rearward movement of either moveable member pulls a respective cord that operates through a one way clutch to rotate a respective flywheel.

The present invention also provides a method of making a flywheel designed to rotate subject to frictional resistance created by contact between a drag strap and an outer cylindrical surface on the flywheel. As noted above, experimentation established that for greater reliability, the outer cylindrical surface is prepared to have a surface roughness of between fifty (50) microinches and one hundred and twenty (120) microinches, as measured "peak to valley" using a profilometer. In particular, after being sand cast, the #30 grey iron flywheel is painted black for aesthetic purposes and then, mounted on a lathe made by SUGA, in order to drill or bore a hole through the center of the flywheel and "cut" the contact surface on the circumference of the flywheel.

A 35 degree carbide insert is used to cut a groove in the circumference of the flywheel, thereby creating the contact surface and the bordering peripheral flanges. A high speed steel drill and boring bar is used to bore the hub contemporaneously with the groove cutting. With the "feed" dial set at "11", a "rough cut" is made at approximately 200 revolutions per minute, and then a "finish cut" is made at approximately 900 revolutions per minute. On another type of lathe, made by Cincinnati Milicron, a 35 degree ceramic insert is used to cut the groove in the circumference of the flywheel. The lathe rotates the flywheel at approximately 900 revolutions per minute, while the groove cutting insert moves across the circumference of the flywheel at the rate of 0.008 inches per revolution. The flywheel hub is drilled separately using a carboloy indexable insert drill that penetrates the hub of the flywheel at the rate of 0.005 inches per revolution. In either case, the parameters of the cutting procedure are controlled to ensure that the resulting contact surface has a surface roughness within the desired range, and a sample is selected every hour for measurement of surface roughness using a profilometer.

The present invention has been described with reference to a preferred embodiments and methods. However, those skilled in the art will recognize a variety of alternative embodiments and additional applications that fall within the scope of the present invention. Accordingly, the present invention is to be limited only by the appended claims.

We claim:

1. A method of manufacturing a flywheel designed to rotate subject to frictional resistance created by contact between a drag strap and an outer cylindrical surface on the flywheel, comprising the steps of cutting a groove into the circumference of the flywheel to create an outer cylindrical surface disposed between a pair of peripheral flanges, and preparing the outer cylindrical surface to have a surface roughness of between fifty and one hundred and twenty microinches.

2. A method according to claim 1, further comprising the step of sand casting the flywheel prior to the step of preparing the outer cylindrical surface.

3. A method according to claim 1, further comprising the step of painting the flywheel black prior to the step of preparing the outer cylindrical surface.

4. A method according to claim 3, further comprising the step of boring a hole through the flywheel.

5. A method according to claim 1, wherein a hole is bored through the flywheel contemporaneously with the step of preparing the outer cylindrical surface.

6. A method of manufacturing an exercise resistance mechanism, comprising the steps of: fabricating a flywheel; preparing an outer cylindrical surface on the flywheel in such a manner that the outer cylindrical surface has a surface roughness between twenty and one hundred and fifty microinches; rotatably mounting the flywheel relative to a frame; disposing a drag strap about a portion of the outer cylindrical surface; and maintaining tension in the drag strap.

7. A method according to claim 6, wherein the step of forming the outer cylindrical surface involves cutting a groove in the circumference of the flywheel.

8. A method according to claim 7, wherein the step of disposing the drag strap about a portion of the outer cylindrical surface involves positioning the drag strap within the groove and between peripheral flanges that border the groove.

9. A method according to claim 8, wherein the step of maintaining tension in the drag strap involves placing a spring in series with the drag strap and securing opposite ends of the series relative to the frame.

10. A method according to claim 6, wherein the step of rotatably mounting the flywheel relative to a frame involves boring a hole through the flywheel, passing a shaft through the hole, and rotatably mounting the shaft relative to the frame.

11. A method according to claim 10, further comprising the step of operatively connecting the shaft to an exercise element movably mounted relative to the frame.

12. A method according to claim 11 wherein the step of operatively connecting the shaft to an exercise element involves mounting a one-way clutch on the shaft and associating the exercise element with the one-way clutch in such a manner that movement of the exercise element in a first direction relative to the frame causes rotation of the shaft, and movement of the exercise element in a second, opposite direction relative to the frame is independent of the shaft.

13. A method according to claim 6, further comprising the step of sand casting each of the flywheels prior to the step of preparing the outer cylindrical surface.

* * * * *